United States Patent [19]

Rubbo et al.

[11] Patent Number: 4,612,985

[45] Date of Patent: Sep. 23, 1986

[54] SEAL ASSEMBLY FOR WELL TOOLS

[75] Inventors: Richard P. Rubbo; David M. Haugen, both of Houston, Tex.

[73] Assignee: Baker Oil Tools, Inc., Orange, Calif.

[21] Appl. No.: 758,406

[22] Filed: Jul. 24, 1985

[51] Int. Cl.[4] ..... E21B 33/12

[52] U.S. Cl. ..... 166/114; 166/116; 166/380; 166/387; 285/18

[58] Field of Search ..... 166/387, 381, 380, 114, 166/115, 116, 242, 237, 214; 285/18, 302; 267/125; 188/316

[56] References Cited

U.S. PATENT DOCUMENTS

| | | | |
|---|---|---|---|
| 1,712,029 | 5/1929 | Crowell et al. | 166/115 |
| 2,323,321 | 7/1943 | Futral | 267/125 |
| 3,083,768 | 4/1963 | Althouse, Jr. et al. | 166/114 |
| 3,107,930 | 10/1963 | Gibbs et al. | 285/18 |
| 3,136,366 | 6/1964 | Brown et al. | 166/114 |
| 3,252,516 | 5/1966 | Leutwyler | 285/3 |
| 4,477,104 | 10/1984 | Akkerman | 285/18 |
| 4,512,406 | 4/1985 | Vann et al. | 166/297 |

FOREIGN PATENT DOCUMENTS

| | | | |
|---|---|---|---|
| 810928 | 3/1981 | U.S.S.R. | 166/387 |
| 907215 | 2/1982 | U.S.S.R. | 166/380 |

*Primary Examiner*—James A. Leppink
*Assistant Examiner*—Hoang C. Dang
*Attorney, Agent, or Firm*—Norvell & Associates

[57] ABSTRACT

A method and apparatus for inserting a seal stack in a seal bore defined by a well tool located downhole where ambient conditions would cause radial swelling of the seal stack. The seal stack is mounted at the surface in a confined space defined between a mandrel and a constraining sleeve shearably connected to the mandrel. Upon run-in of the mandrel to enter the seal bore, the constraining sleeve engages an upwardly facing surface surrounding the entrance to the seal bore which prevents further downward movement of the constraining sleeve. Application of a downward force effects the shearing of the connection between the mandrel and the constraining sleeve and permits the mandrel and seal stack to be inserted in the seal bore while the constraining sleeve moves upwardly relative to the mandrel.

2 Claims, 11 Drawing Figures

SEAL ASSEMBLY FOR WELL TOOLS

BACKGROUND OF THE INVENTION

1. Field of the Invention

This invention relates to a well tool assembly in subterranean oil and gas wells and, more specifically, to a seal assembly for use in the bore of a well tool such as a packer.

2. Description of the Prior Art

Downhole oil tools, such as packers, employed in oil and gas wells are commonly used with seal assemblies in tubing seal receptacles which can be attached to the tubing string which extends to the top of the well. In these conventional tubing seal receptacles, a seal stack, normally comprising an axial array of individual annular seals having a generally V-shaped cross-sectional configuration, is employed to establish sealing integrity between the tubular seal receptacle and the honed surface of the bore of a downhole tool. It is common practice to insert or stab-in a seal assembly on a tubing seal receptacle into the bore of a downhole tool such as a packer which has previously been anchored in position in the well bore. Under conventional environmental conditions within a well bore, these V-shaped seals can be fabricated from conventional elastomeric sealing materials such as nitrile rubber. Although problems can be encountered with inserting or stabbing such conventional seals into a packer bore, an exceptable degree of success has been achieved in establishing sealing integrity with the bore of a packer using these conventional seal assemblies.

Despite the reliability of conventional seal assemblies under normal well conditions, these conventional seals do not establish satisfactory sealing integrity under hostile conditions, such as high temperatures and in the presence of a corrosive chemical environment or other hostile conditions which may be encountered at a subsurface location in a well bore. High-performance sealing elements composed of materials which can withstand these hostile environmental conditions have been utilized. For example, certain elastomeric materials such as ethylene-propylene terpolymer elements, propylene tetrafluoroethylene, perfluoroelastomer, fluorelastomer elements and polytetrofluoroethylene elements perform satisfactorily under hostile conditions.

Despite the excellent sealing properties exhibited by these elastomeric materials under hostile environmental conditions, much difficulty has been encountered in actually inserting seals formed using these elements into the cylindrical bore of a downhole well tool. It has been found that seals formed from these compositions can encounter severe stab-in damage, sometimes resulting in the destruction of the annular seal elements, when seals mounted on a tubing seal receptacle are inserted into the bore of a well packer. It has been speculated that one source of these problems is the expansion or swell of these high-performance sealing elements as the tubing seal receptacle is lowered from the surface to the location of the well tool anchored in the well. For example, excessive thermal expansion can occur in certain elements. Other elements can exhibit significant swell or expansion when exposed to fluids which may be present within a well. For example, in certain wells using petroleum-based drilling fluids, the volume of the high performance sealing elements increases substantially.

SUMMARY OF THE INVENTION

This invention relates to a tubing seal assembly which is adapted to be carried on a tubing string and stabbed into the bore of the well packer or similar well tool anchored in a subterranean oil or gas well to establish fluid communication through the tubing string and the packer or other well tool. An anchor seal assembly, which can comprise a latching member for mechanically engaging the well tool or packer, includes annular sealing elements disposed circumferentially around the tubing seal assembly. These seals must be snugly inserted into the seal bore of the well packer.

These seals are positioned within a cavity on the exterior of the tubular seal receptacle. A cylindrical sleeve surrounds the tubular member and constrains the seals as the seals are inserted into the well prior to engagement of the anchor latch on the well tool bore. The cavity defined on the exterior of the tubular member and covered by the cylindrical sleeve has a volume which is at least equal to the unconstrained volume of the seals under the ambient conditions existing at the surface of the well. The volume of the cavity is, however, less than the unconstrained volume of the seals under the conditions existing at the subsurface location at which the well tool or packer is located.

The cylindrical sleeve is shearably attached to the tubing seal receptacle, but can be shifted axially as the seals are inserted into the bore of the well packer. Thus the seals are maintained in a constrained position by the sleeve during insertion in the well until the time when the seals are inserted or stabbed into the tool seal bore. The seals are, of course, maintained in a constrained configuration after insertion into the seal bore of the packer. Therefore, any swell or expansion of the seals is limited to the volume of the cavity defined on the interior of the packer, and problems heretofore encountered during insertion or stab-in of the seals into the packer seal bore are avoided.

DESCRIPTION OF THE PREFERRED EMBODIMENT

Figure 1A:
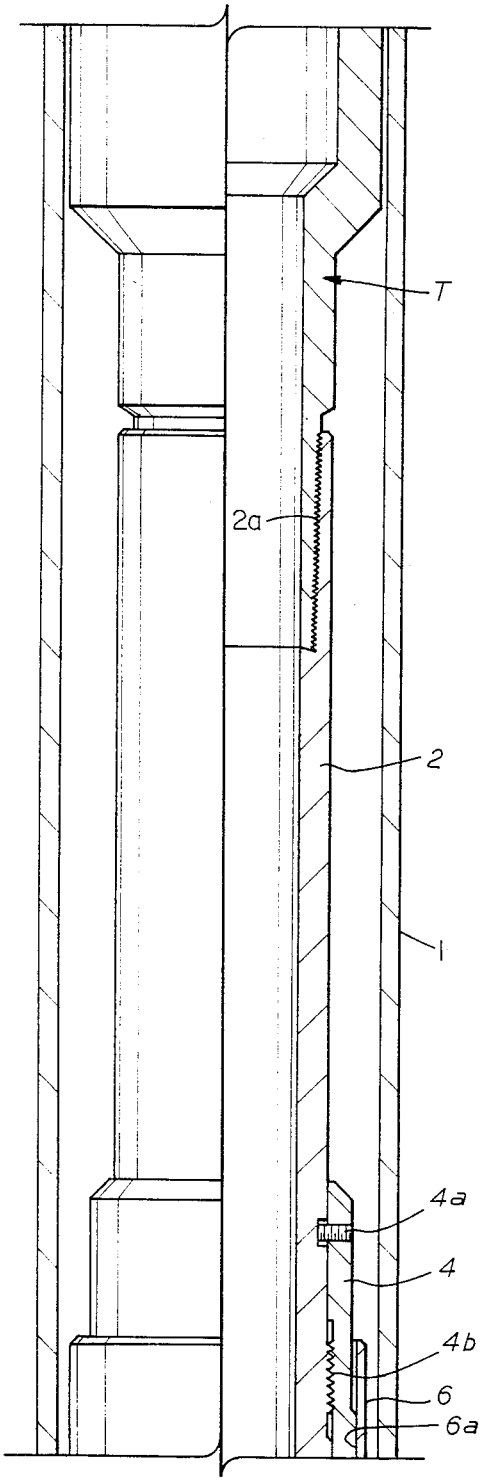
FIGS. 1A, 1B, 1C, 1D and 1E collectively constitute a quarter-sectional view of the tubing seal assembly above the point of initial engagement with the upper end of the seal bore of a well packer located in a well.
Figure 1B:
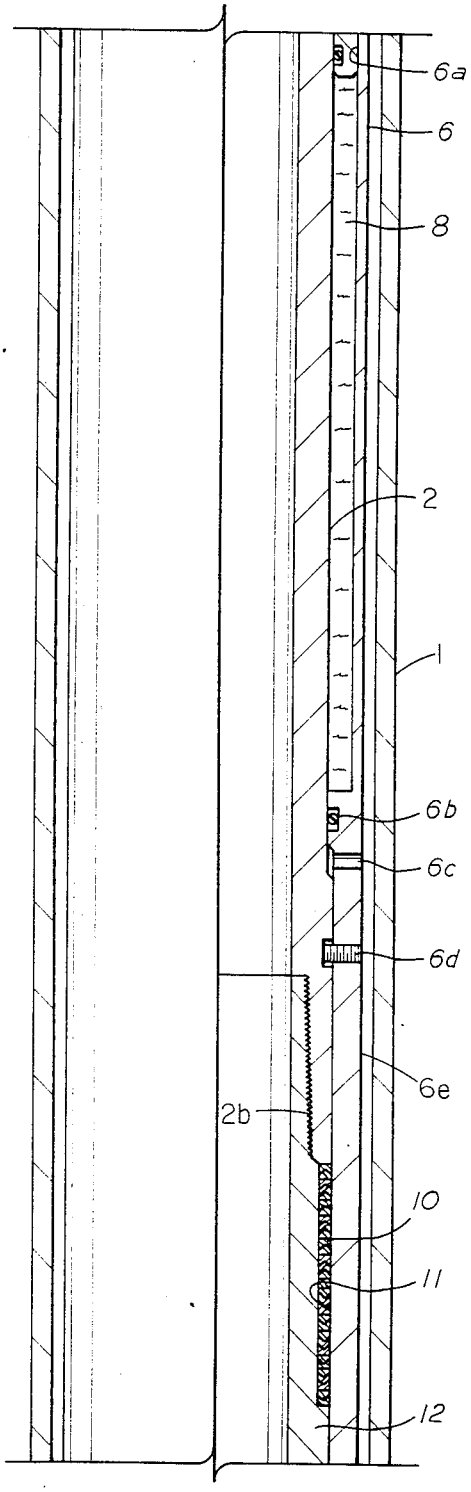
Figure 1C:
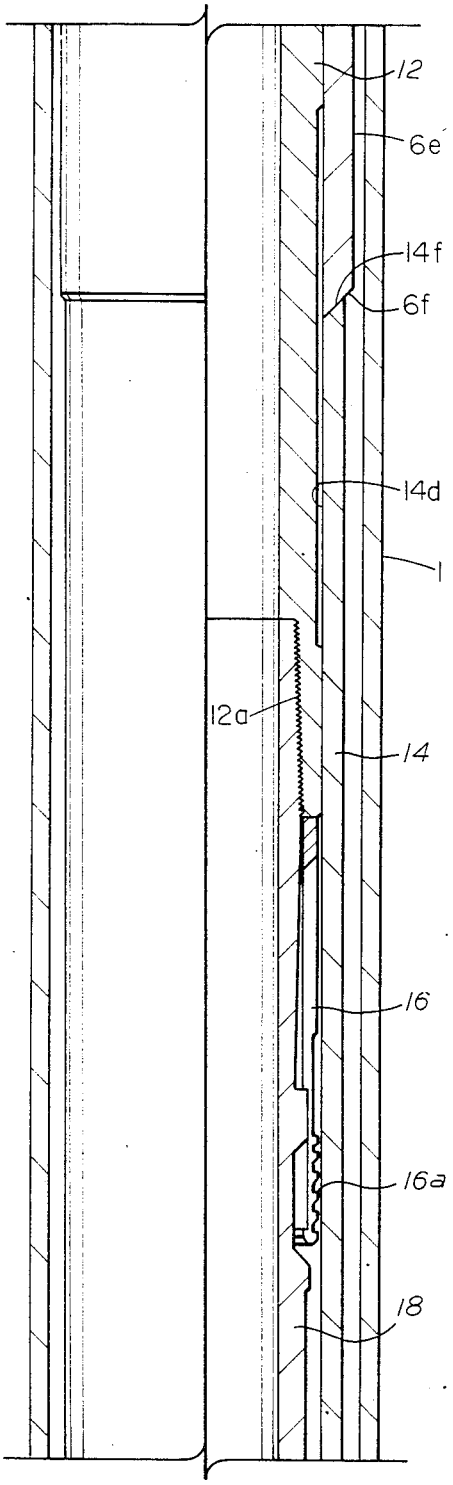

Well packers, such as the packer P are commonly used at subsurface locations to provide sealing integrity between a tubing string inserted within a well casing and the bore of a downhole tool. The packer thus establishes a seal in the annulus between the tubing and the casing. The annular area above the packer is thus isolated from the annular area below the packer. Packers are employed for a number of different downhole operations and can be either permanently anchored within the well or can be of the retrievable type.

The packer P shown in the drawings (FIG. 1E) is of the type generally employed as a permanent packer within a well. Packers such as packer P normally consist of two principal elements. First is an annular packing element, such as packing element 30, which is adapted to radially expand upon the application of an axially compressive force. Conventional packers also employ anchoring means such as radially expandable slips to anchor the packer and the packing element 30 in the well. The packer P employs upper and lower anchoring slips 24 and 38 which are radially expandable to secure the packer within the well casing 1. A number of conventional means are employed to set a packer within a well. For example, packers may be set by tubing manipulation, by the action of hydraulic pressure, or by manipulation of the components of the packer by a wireline string extending to the surface of the well and attached to wireline tools for engaging and setting the packer.

During the operation of a downhole tool such as a packer P, it is necessary under certain circumstances to insert a tubing string into the well and establish communication with a bore of a packer anchored at a subsurface location. The conventional manner of establishing such communication is to establish sealing integrity with the bore of the packer or with an extension thereof. Thus, sealing elements are commonly provided on the exterior of the tubing inserted into the bore of the packer. These seals engage a seal bore surface in the bore of the packer or in a seal bore extension of the packer. FIGS. 1A, 1B, 1C, 1D and 1E show the packer P, a seal-bore extension 14 extending upwardly therefrom, and a sealing element 10 of the type employed in the preferred embodiment of this invention. It should be understood, however, that these Figures do not depict the seal system or the packer P in their interengaged configuration as used in the well and, these Figures are merely intended to illustrate separate positions of both the sealing assembly and the Packer P, prior to establishing the aforementioned sealing integrity.

As shown in FIG. 1A, a portion of the tubing string, consisting of tubing T, is attached to a tubular member 2 by threads **2*a*. A tubular sleeve 4 is connected to the exterior of tubular member 2 by means of conventional threads 4*b* and a set screw 4*a*. An outer seal constraining sleeve 6 extends below the upper tubular sleeve 4 and partially overlaps a portion of the tubular sleeve 4 (FIG. 1B) along the upper portion of the inner bore 6*a* of the outer constraining sleeve 6. The upper portion of the constraining sleeve 6 has inner diameter slightly in excess of the outer diameter of the tubular sleeve 4. No sealing integrity is established along the portion of the inner surface 6*a* of the upper constraining sleeve portion which overlaps the tubular sleeve 4. An annular cavity 8, however, is defined around the tubular sleeve 4. A suitable fluid may be deposited within cavity 8 during assembly of the sealing assembly. The purpose of the fluid contained within cavity 8** will be apparent subsequently.

The constraining sleeve 6 is attached to the tubular member 2 by means of one or more threaded shear pins **6*d* located below cavity 8. A conventional O-ring seal 6*b* is disposed along the inner bore of carrier sleeve 6 below the cavity 8 and above the pin 6*d*. A suitable vent hole 6*c* is located immediately below the seal 6*b*, but O-ring seal 6*b* establishes sealing integrity between the tubular member 2 and the constraining sleeve 6 below the cavity 8. Thus, the cavity 8 is open at its upper end to the exterior along surface 6*a*, but sealing integrity is established below the cavity 8 by the O-ring seal 6*b***.

Figure 3:
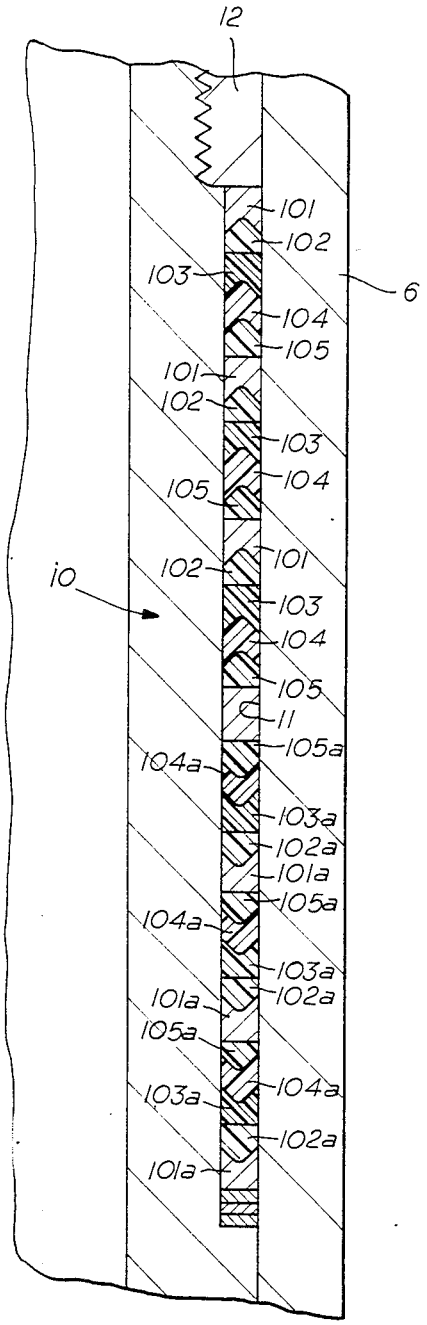
FIG. 3 is a sectional view of the geometric configuration of a seal assembly which can employ high-performance sealing elements subject to swell or expansion under hostile environmental conditions in a well.

Tubular member 2 is attached at its lower end to a seal carrier sleeve or mandrel 12, by threads **2*b*. A seal assembly 10, which will be described in detail with reference to FIG. 3, is located between the seal carrier section 12 and the tubular member 2. The seal assembly 10 is retained within an annular cavity between the carrier 12 and the lower portion 6*e* of constraining sleeve 6. The cavity within which the seal assembly 10 is retained has a volume which is less than the volume of the seal assembly 10 under the conditions which will exist at a downhole location in which the packer P is located. A detailed discussion of this relationship will be presented with reference to FIG. 3**.

The lower portion of seal carrier 12 abuts a spring-loaded latching collet 16 (FIG. 1C) having latching threads **16*a* at its lower end. The latching element 16*a*** is of the conventional type adapted to engage similar threads in a packer or a seal bore extension thereof.

Figure 1D:
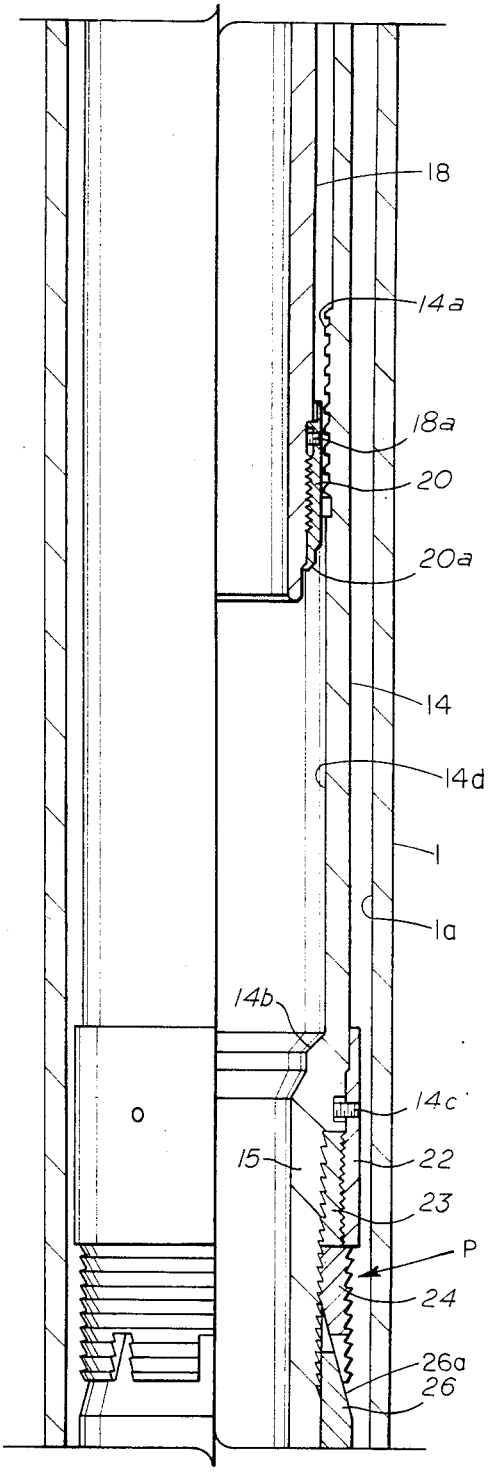

As shown in FIG. 1D, the upper seal bore extension 14 of the packer P comprises a tubular member having internal threads **14*a* located intermediate its ends. Threads 14*a* are the type adapted to engage with the threads 16*a* located on the latching collet 16 affixed to receptacle extension 18**.

An upwardly facing inclined shoulder **14*b* is provided at the lower end of the upper portion of the seal bore receptacle 14 and comprises the section of the packer intermediate the upper seal bore receptacle and the main body 15 of the packer. A metal sealing ring 20 is attached at the lower end of the tubular seal receptacle extension 18 which is attached to the bottom end of seal carrier 12 by threads 12*a*. This metal sealing ring 20 can be fabricated from a soft metal, and as can be seen in FIG. 1, is opposed to the upwardly facing shoulder 14*b* at the upper end of the body 15**.

Figure 1E:
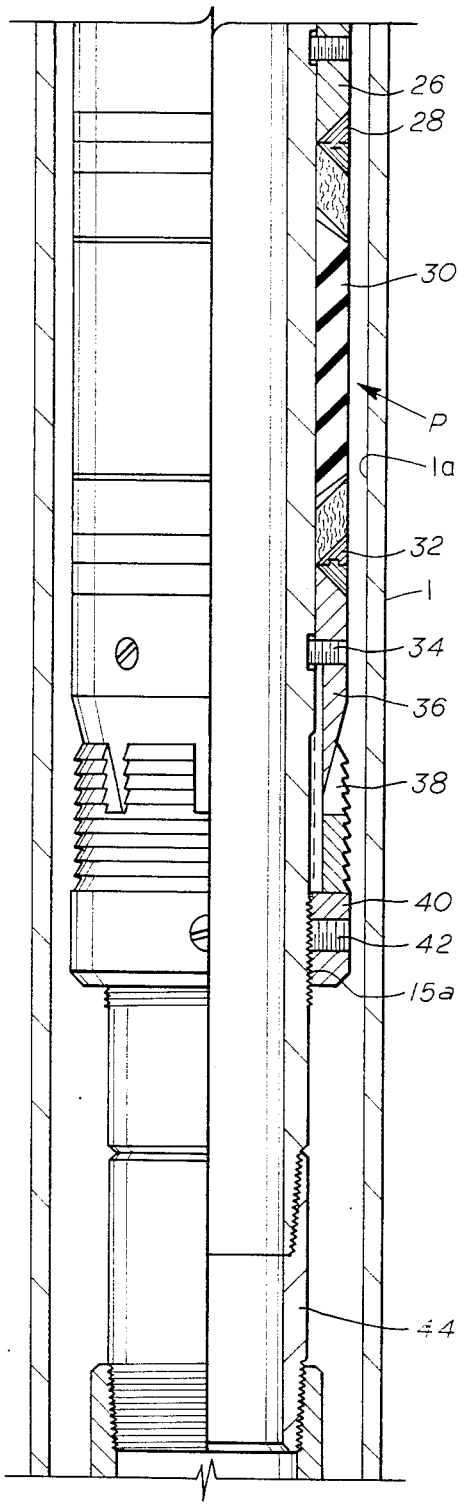

As stated, the conventional packer P shown in FIGS. 1D and 1E comprises a permanent-type packer. An upper gage ring 22 is secured to body 15 of the packer by a pin **14*c*. Radially expanding slips 24 of the conventional type are located below the gage ring 22. Although not shown in detail in FIG. 1D, a conventional locking arrangement, such as a body lock 23 which engages external threads on the body 15 of the packer and internal threads on gage ring 22, is located above the slips 24. A slip expander cone 26 is located immediately below slips 24 and has an upwardly facing inclined surface 26*a* to radially expand the anchoring slips 24 upon axial contraction of components of the packing element. Immediately below the expander cone 26 is a radially expandable extrusion ring 28 of the conventional type. A packing element assembly 30 is located between upper and lower extrusion rings 28 and 32**, which can be of the conventional type.

A lower expander cone 36 is secured to the packer body 15 by a shear pin 34. Lower slips 38 suitable for anchoring the packer against downwardly directed forces are located in engagement with the inclined surface of cone 36.

A lower gage ring 40 is located below slips 38 and is secured to the body 15 of the packer by threads **15*a*. A pin 42 extends through the gage ring 40 to further secure the lower gage ring in position. If additional segments of the tubing string are to be attached below the packer P, a crossover coupling 44** can be located therebelow for attachment of the lower portions of the tubing string or a tailpipe. The packer P shown herein corresponds in general to a conventional packer such as the Baker Model DA Retainer Production Packer or the Baker Model HEA Retainer Production Packer.

FIG. 2A, 2B, 2C, 2D and 2E show the configuration of the packer and seal receptacle assembly when the packing element 30 and the slips 24 and 38 are radially expanded into engagement with the casing bore 1*a* and the seals 10 stabbed into the seal receptacle 14 of the packer. Additionally, a seal has been established by the engagement of the metal seal ring 20 with the upwardly facing shoulder 14*b* at the juncture between the seal bore extension 14 and the main body 15 of the packer P. Thus, redundant sealing integrity is established both by the metal seal ring 20 and by the seal assembly 10, preventing any leakage from the bore of the packer P to the annulus above the packer.

When the packing elements 30 and the anchoring slips 24 and 38 are expanded to secure the packer P in place, the seal assembly 10 can be stabbed-in into the packer seal bore extension 14. As the seal assembly 10 is first inserted into the seal bore extension 14, the seal assembly 10 will occupy the position shown in FIG. 1B. FIG. 1D shows that the metal seal ring 20 has not been inserted into engagement with the upwardly facing shoulder 14*b*, in other words, the seal assembly has not been inserted or "stabbed in" into the packer bore. Note also that sleeve 6 is in its downward position with shear pin 6*d* intact. In this position, the seal assembly 10 is completely retained within the cavity formed by the constraining sleeve 6, the end of tubular member 2 and the seal carrier 12. In the position shown in FIG. 1C, the lower end surface 6*f* of the constraining sleeve 6 has come into engagement with the upper end surface 14*f* of the seal receptacle 14. Continued downward force applied to the tubing string will then result in relative movement between the tubular member 2 and the constraining sleeve 6. Upon the application of sufficient downwardly directed force, shear pin 6*d* is severed and the tubular member 2 and extension 18 continue to move downwardly relative to constraining sleeve 6. More importantly, the seal stack 10 also continues to move downwardly relative to the carrier sleeve and is ultimately inserted or "stabbed-in" into the seal receptacle 14 to establish engagement and sealing integrity with the inner surface 14*d* of the seal receptacle 14. Additionally, the threads 16*a* of collet 16 will engage threads 14*a* on seal bore extension 14.

Figure 2A:
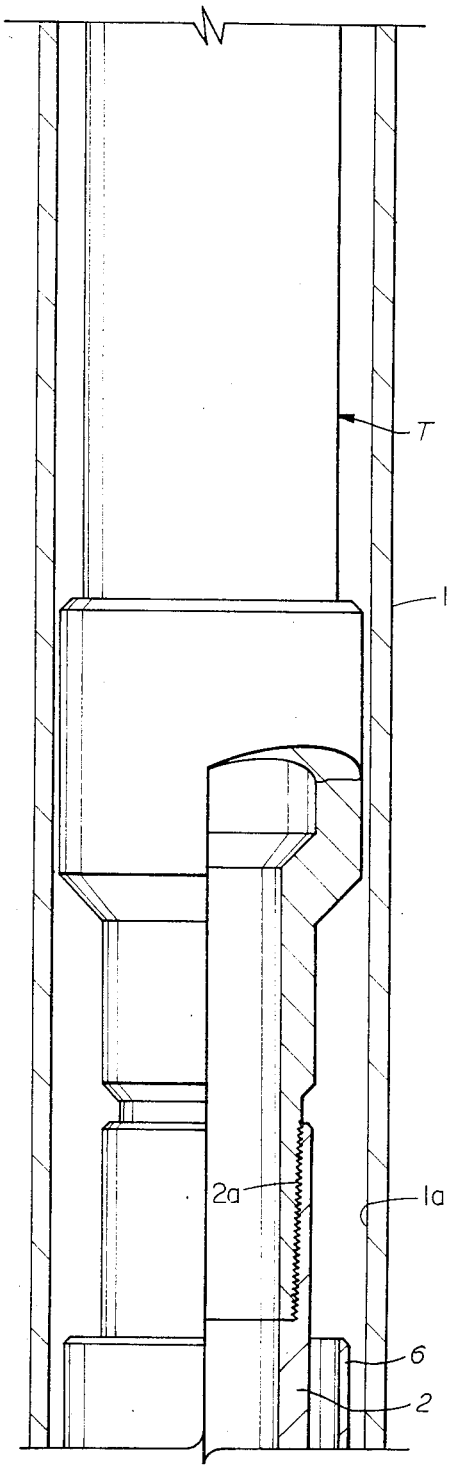
FIGS. 2A, 2B, 2C, 2D and 2E are views similar to FIGS. 1A, 1B, 1C, 1D and 1E, but showing the seal assembly fully inserted into the packer seal bore.
Figure 2B:
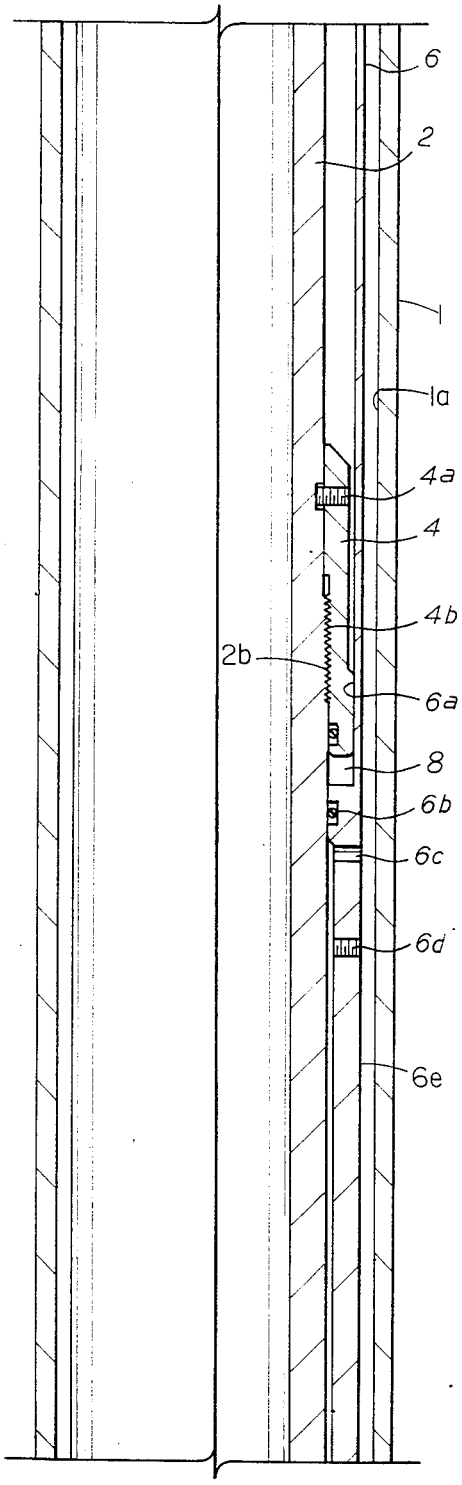
Figure 2C:
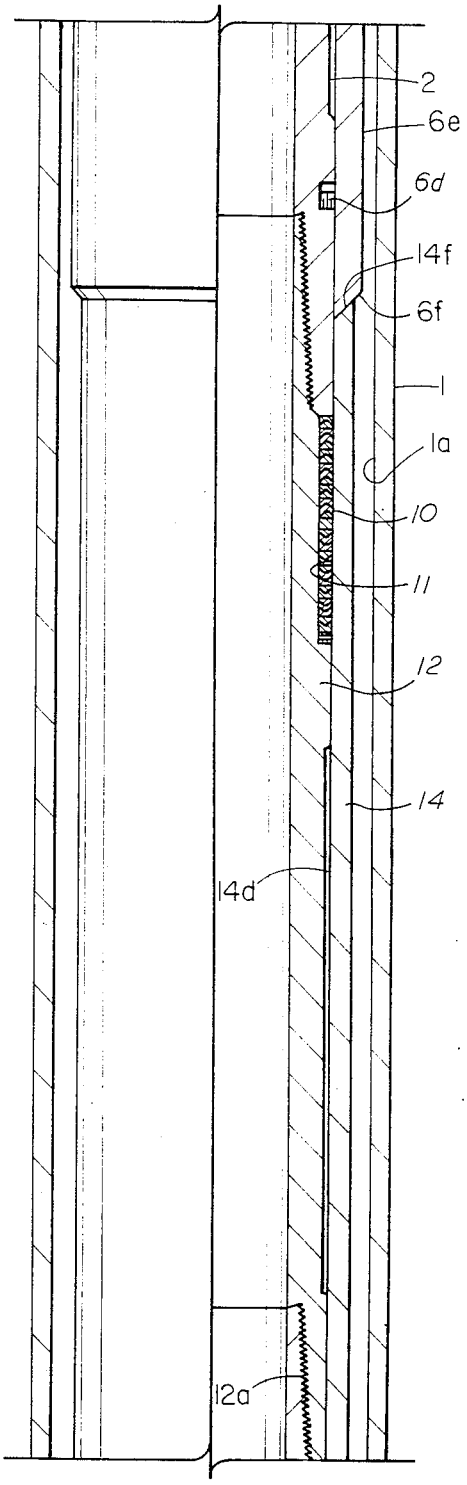
Figure 2D:
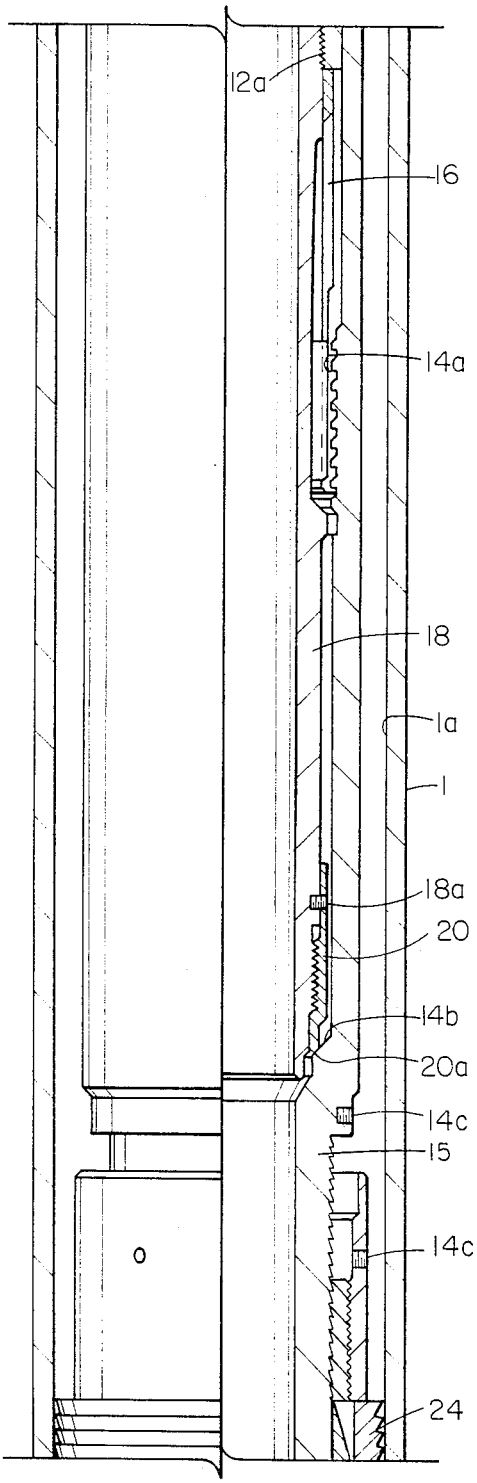
Figure 2E:
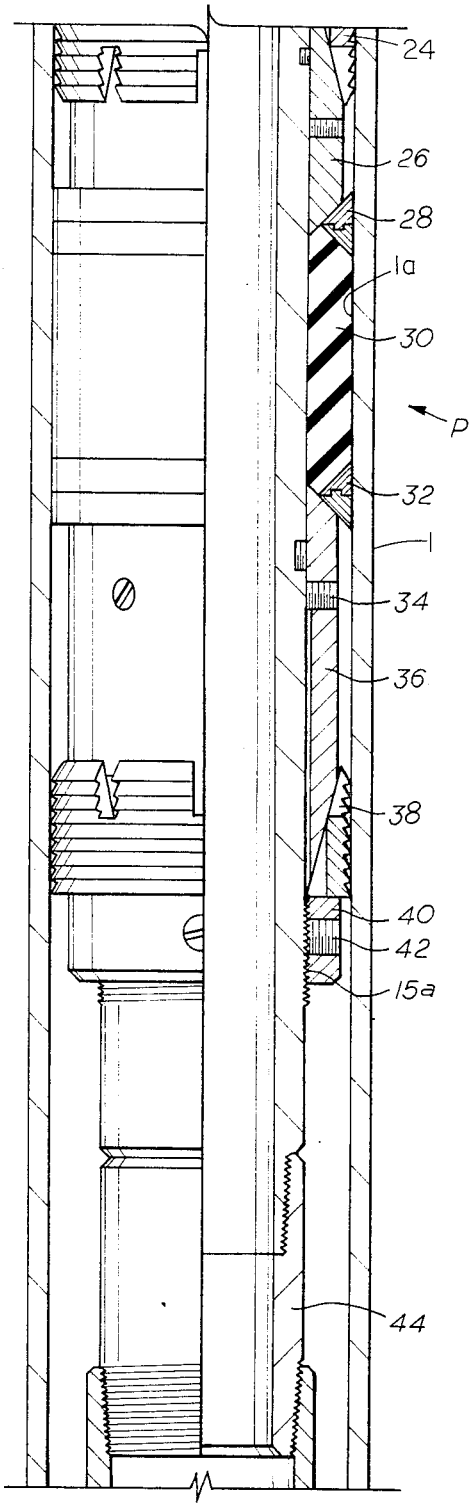

The inner portion of the seal assembly 10 ultimately is inserted into the seal receptacle 14 to a degree sufficient to allow sealing engagement between the metal sealing ring 20 and the upwardly facing shoulder 14*b*, as shown in FIG. 2D.

The liquid located in cavity 8 serves to dampen movement of the telescoping inner mandrel assembly 2 and 12 relative to the constraining sleeve 6. Since there is no sealing engagement along surface 6*a*, the liquid located in cavity 8 can be forced outwardly through the upper end of the cavity, thus creating a dampening effect which can prevent damage to the seal assembly 10 and to the metal seal ring 20, which might be caused by rapid engagement of either with the inner surface of the seal receptacle 14.

The operation of the constraining sleeve 6 to prevent damage to the seal stack 10 can be understood more completely with reference to FIG. 3. The configuration of the seal stack 10 shown in FIG. 3 is generally conventional and comprises a plurality of upwardly and downwardly facing annular seal units. Each separate seal unit comprises a metal backup or spacer 101 in engagement with a first polymeric backup ring 102. Note that the engagement between the metal ring 101 and the polymeric backup member 102 is along a convex-concave mating surface. In the preferred embodiment of this invention the polymeric element 102 can comprise an annular member formed of a material such as that sold under the trademark Ryton, a trademark of Phillips Petroleum. A second backup member 103 is located in engagement with the backup 102. In the preferred embodiment of this invention, the secondary backup can comprise a member formed of polytetrofluoroethylene, commonly referred to under the trademark Teflon, a trademark of DuPont. The primary sealing element 104 comprises an annular member having a cheveron cross-section. Each seal unit is further comprised of a second polymeric backup member 105 in engagement with the opposite end of the primary sealing element 104. This second backup element 105 can also comprise an element formed of a material such as Ryton.

The primary sealing element 104 can be fabricated from a plurality of different types of materials. For example, these sealing elements can be formed of material such propylene tetrafluoroethylene. The primary sealing element also can be formed of a perfluoroelastomer, such as Kalrez, a trademark of DuPont. Another material which also exhibits excellent sealing characteristics comprises fluoroelastomer. This invention can also be employed with other more conventional sealing elements, such as polytetrofluoroethylene elements or polybutadiene-coacrylonitrile elements, if anticipated swell in downhole conditions requires use of this configuration. Such swell can arise from a number of factors. For example, some elements undergo a volumetric expansion when placed in certain oil-based materials. Furthermore, elevated temperatures at downhole locations can also result in thermal expansion of the seal elements.

A number of the seal elements which exhibit good sealing characteristics also exhibit swell or volumetric expansion, which had been found to be a problem when the sealing stack is to be inserted or stabbed into the bore of a seal receptacle. In this invention, the seal stack 10 is always confined to a cavity 11 having a volume which is less than the volume that the seal unit would occupy when subjected to downhole conditions, if it were unconstrained. As the seal stack is inserted into the well, this cavity 11 is defined by the tubular member 2, the seal carrier 12, and the constraining sleeve 6. When inserted into the seal bore receptacle 14, this cavity is defined by the end of tubular member 2, the seal carrier 12, and the seal bore 14*d* of the packer P; the carrier sleeve 6 having been moved upwardly relative to the seal stack 10. This prevents the seal stack from being damaged or destroyed when stabbed-in or inserted into the seal bore receptacle 14.

As can be seen from FIG. 3, the multicomponent seal stack can easily be damaged if it is forcibly inserted into the seal receptacle 10 after swelling. As the lower seal elements are inserted into the bore, if they can be inserted therein, the friction due to the close engagement of the primary sealing elements with the inner bore 14*d* of the seal receptacle 14 exerts an upwardly directed force on the other sealing elements. If these upper sealing elements have expanded significantly beyond their volume when the seal assembly is originally assembled, they cannot be inserted into the bore of the packer and will be swabbed off or stripped from the seal assembly. Such damage has often occured when high-performance seal stacks are to be used and represents a continuing problem, which has now been solved in a reliable and economic manner.

Although the invention has been described in terms of specified embodiments which as set forth in detail, it should be understood that this is by illustration only and that the invention is not necessarily limited thereto, since alternative embodiments and operating techniques will become apparent to those skilled in the art in view of this disclosure. Accordingly, modifications are contemplated which can be made without departing from the spirit of the described invention.

What is claimed and desired to be secured by Letters Patent is:

1. A tubing seal assembly adaptable to be stabbed into the bore of a well packer anchored in a subterranean oil or gas well upon insertion of a tubing string into the well bore to establish fluid communication through the packer, comprising: means for attaching the tubing seal assembly to the tubing string; a tubular member extending from the attaching means; seal means disposed about the periphery of said tubular member; a constraining sleeve shearably attached to said tubular member and defining an annular cavity around said tubular member; seal means inserted in said cavity; the volume of the cavity being at least equal to the unrestrained volume of the seal means at the surface of the well, and less than the unrestrained volume of the seal means at the subsurface location of the packer; engagable surfaces respectively provided on said packer and said constraining sleeve to move said constraining sleeve upwardly relative to said tubular member as said seal means is inserted in said packer bore, whereby sealing integrity can be established with the bore of the well packer upon insertion of the tubing seal assembly into the well packer bore without damaging the seal means; and means for continuously damping said upward movement of said constraining sleeve relative to said tubular member.

2. The tubing seal assembly of claim 1 wherein the damping means comprises a chamber defined between the constraining sleeve and the tubular member having a restricted discharge passage, and a fluid disposed in the chamber.

* * * * *